US011525585B2

(12) United States Patent
Qiao et al.

(10) Patent No.: US 11,525,585 B2
(45) Date of Patent: Dec. 13, 2022

(54) METHOD AND APPARATUS FOR CONTROLLING WATER HEATER, WATER HEATER, AND CONTROLLING SYSTEM THEREOF

(71) Applicants: GREE ELECTRIC APPLIANCES (WUHAN) CO., LTD, Hubei (CN); GREE ELECTRIC APPLIANCES, INC. OF ZHUHAI, Guangdong (CN)

(72) Inventors: Xuewen Qiao, Guangdong (CN); Wenxuan Tao, Guangdong (CN); Biao Chen, Guangdong (CN)

(73) Assignees: GREE ELECTRIC APPLIANCES (WUHAN) CO., LTD, Hubei (CN); GREE ELECTRIC APPLIANCES, INC. OF ZHUHAI, Zhuhai (CN)

( * ) Notice: Subject to any disclaimer, the term of this patent is extended or adjusted under 35 U.S.C. 154(b) by 276 days.

(21) Appl. No.: 16/606,173

(22) PCT Filed: Dec. 25, 2017

(86) PCT No.: PCT/CN2017/118393
§ 371 (c)(1),
(2) Date: Oct. 17, 2019

(87) PCT Pub. No.: WO2018/192258
PCT Pub. Date: Oct. 25, 2018

(65) Prior Publication Data

US 2020/0049354 A1 Feb. 13, 2020

(30) Foreign Application Priority Data

Apr. 19, 2017 (CN) ..... 201710257115.2

(51) Int. Cl.
*F24D 19/10* (2006.01)
*F24D 17/00* (2022.01)
*F24H 9/20* (2022.01)

(52) U.S. Cl.
CPC ..... *F24D 19/1051* (2013.01); *F24D 17/0078* (2013.01); *F24H 9/2021* (2013.01)

(58) Field of Classification Search
CPC .. F24D 19/10; F24D 19/1009; F24D 19/1051; F24D 17/0078; F24H 9/20;
(Continued)

(56) References Cited

U.S. PATENT DOCUMENTS

2015/0044062 A1* 2/2015 Halff ..... F24D 17/0078 417/43
2015/0276266 A1 10/2015 Warren et al.
(Continued)

FOREIGN PATENT DOCUMENTS

CN 201983421 9/2011
CN 201983421 U * 9/2011
(Continued)

OTHER PUBLICATIONS

Office Action dated Aug. 18, 2020 for Japanese Patent Application No. 2019-557401 (5 pages).
(Continued)

*Primary Examiner* — Edelmira Bosques
*Assistant Examiner* — Michael James Giordano
(74) *Attorney, Agent, or Firm* — J. Miguel Hernandez; James R. Gourley; Carstens, Allen & Gourley, LLP

(57) ABSTRACT

A method for controlling a water heater comprising: receiving report information transmitted by a user-wearable device at a predetermined frequency; determining whether a user is coming back according to user location information included in the report information; and if the user is coming
(Continued)

back, turning on a return water pump to permit water outputted from a water outlet of the water heater to return to the water heater through a water return port. The present disclosure determines a movement direction and the user location by using report information transmitted by the user-wearable device. If the user is coming back, the return water pump is turned on to permit water to return, so that the user can take a hot bath immediately after arriving home, thereby improving user's experience.

6 Claims, 5 Drawing Sheets

(58) Field of Classification Search
CPC .... F24H 9/2007; F24H 9/2014; F24H 9/2021; G05B 2219/2642
See application file for complete search history.

(56) References Cited

U.S. PATENT DOCUMENTS

2015/0349972 A1* 12/2015 Deivasigamani ... H04L 12/2816 700/275
2016/0169539 A1* 6/2016 Deivasigamani ... F24D 19/1009 237/12

FOREIGN PATENT DOCUMENTS

| | | | | |
|---|---|---|---|---|
| CN | 202419928 | | | 9/2012 |
| CN | 104110888 | | | 10/2014 |
| CN | 104879924 | | | 9/2015 |
| CN | 104879924 | A | * | 9/2015 |
| CN | 104990280 | | | 10/2015 |
| CN | 105263114 | | | 1/2016 |
| CN | 105263114 | A | * | 1/2016 |
| CN | 105299906 | | | 2/2016 |
| CN | 105299906 | A | * | 2/2016 |
| CN | 105698396 | | | 6/2016 |
| CN | 106052142 | | | 10/2016 |
| CN | 106931650 | | | 7/2017 |
| CN | 108286808 | B | * | 10/2020 |
| DE | 29623412 | U1 | | 6/1998 |
| EP | 2793097 | A2 | | 10/2014 |
| EP | 3131315 | A1 | | 2/2017 |
| JP | 2004-147133 | A | | 5/2004 |
| JP | 2006-13563 | A | | 1/2006 |
| JP | 2008-170099 | A | | 7/2008 |
| JP | 2010203668 | | | 9/2010 |
| JP | 2011196606 | | | 10/2011 |
| JP | 2011-220655 | A | | 11/2011 |
| JP | 2012-88214 | A | | 5/2012 |
| JP | 2014-173752 | A | | 9/2014 |
| KR | 10-0757381 | B1 | | 9/2007 |
| KR | 10-2014-0052197 | A | | 5/2014 |
| KR | 10-1641165 | B1 | | 7/2016 |
| KR | 10-2016-0145987 | A | | 12/2016 |
| WO | 2015/121856 | A1 | | 8/2015 |
| WO | 2016/167575 | A1 | | 10/2016 |

OTHER PUBLICATIONS

Extended European Search Report dated Mar. 5, 2020 for European Patent Application No. 17906162.7 (8 pages).
Office Action dated Aug. 11, 2020 for Korean Patent Application No. 10-2019-7029206 (7 pages).

* cited by examiner

METHOD AND APPARATUS FOR CONTROLLING WATER HEATER, WATER HEATER, AND CONTROLLING SYSTEM THEREOF

CROSS-REFERENCE TO RELATED APPLICATIONS

This application is a US 371 Application from PCT/CN2017/118393 filed Dec. 25, 2017, which claims priority to the Chinese application No. 201710257115.2, titled "METHOD AND APPARATUS FOR CONTROLLING WATER HEATER, WATER HEATER, AND CONTROLLING SYSTEM THEREOF", filed on Apr. 19, 2017, the contents of which are herein incorporated by reference in their entirety.

TECHNICAL FIELD

The disclosure relates to the field of automatic control, and in particular, to a method and an apparatus for controlling a water heater, a water heater, and a controlling system thereof.

BACKGROUND

With the improvement of life quality of people, taking physical exercise has become a first choice in leisure time, and people usually need to take a bath after taking part in physical exercises. Usually, there is a certain distance from the water tank of the water heater to the shower head, therefore, the cold water in the water pipe needs to be discharged before the hot water is discharged, which will cause waste of water resources.

In order to save water resources, a water heater with the function of water return is provided. As shown in FIG. 1, cold water enters the water tank of the water heater 1 through the water inlet 11 of the water heater 1 and is heated and hot water flows out of the hot water outlet 12. The user adjusts the proportion of the hot water and the cold water entering through the cold water outlet 21 by adjusting the mixing valve 2 so that the mixed water will finally flow out of the shower head 3. In order to avoid the defect that the cold water is discharged first when the user takes a bath, the return water pump 4 is provided on the pipe between the hot water outlet 12 of the water heater 1 and the water return port 13. When the return water pump 4 is turned on, the cold water in the pipe between the hot water outlet 12 and the mixing valve 2 can return to the water tank of the water heater 1 through the water return port 13 and be heated, thereby ensuring that hot water can directly flow out of the shower head when the user takes a shower and avoiding waste of water resources.

However, the user cannot operate the return water pump before finishing the physical exercise and going home, and it will take some time for the water to return, therefore the user cannot take a hot bath immediately after arriving home, making the user's experience worse.

SUMMARY

The embodiments of the present disclosure provide a method and an apparatus for controlling a water heater, a water heater, and a controlling system thereof. The present disclosure determines a movement direction and the user location by using information reported by the wearable device of the user. If the user is coming back, the return water pump is turned on to permit water to return, so that the user can take a hot bath immediately after arriving home.

In accordance with one aspect of the present disclosure, a method for controlling a water heater is provided, which includes:

receiving report information transmitted by a device of a user at a predetermined frequency;

determining whether the user is coming back according to user location information included in the report information; and if the user is coming back, turning on a return water pump to permit water outputted from a water outlet of the water heater to return to the water heater through a water return port.

In an embodiment, detecting a temperature of water output from the water outlet; if the temperature of the water output from the water outlet exceeds a preset temperature value, turning off the return water pump.

In an embodiment, acquiring weather conditions of the day; presetting a temperature value according to the weather conditions of the day.

In an embodiment, adjusting the preset temperature value according to the user's physiological indexes included in the report information.

In an embodiment, adjusting the preset temperature value according to preferences of the user.

In an embodiment, after receiving the report information transmitted by the device of the user, the method further includes:

determining whether the water heater is currently in a specified work mode;

if the water heater is currently in the specified work mode, further determining whether current time is within a preset time range of the specified work mode; and if the current time is within the preset time range of the specified work mode, then performing a step of determining whether the user is coming back according to the user location information included in the report information.

In an embodiment, a step of determining whether the user is coming back according to the user location information included in the report information includes:

determining whether the user is moving toward a location of the water heater according to the user location information included in the report information;

if the user is moving toward the location of the water heater, further determining whether a distance between the current user location and the location of the water heater is less than a first predetermined distance; and if the distance between the current user location and the location of the water heater is less than the first predetermined distance, determining that the user is coming back.

In an embodiment, if the user is moving toward the location of the water heater, the method further includes:

determining whether the distance between current user location and the location of the water heater is less than a second predetermined distance, wherein the second predetermined distance is greater than the first predetermined distance; and if the distance between the current user location and the location of the water heater is less than the second predetermined distance, starting the water heater to heat when the water heater is in a non-heating state, and then performing a step of determining whether the distance between the current user location and the location of the water heater is less than the first predetermined distance.

In an embodiment, a step of determining whether the user is moving toward the location of the water heater according to the user location information included in the report information includes:

setting the distance between the current user location and the location of the water heater to be a first distance;

setting the distance between the user location before a predetermined time interval and the location of the water heater to be a second distance; and if the first distance is less than the second distance, determining that the user is moving toward the location of the water heater.

In an embodiment, the device of a user is a wearable device of the user.

According to another aspect of the disclosure, an apparatus for controlling a water heater is provided, which includes a receiving module, a state identification module and a return water pump control module:

the receiving module is configured to receive report information transmitted by a device of a user at a predetermined frequency;

the state identification module is configured to determine whether the user is coming back according to user location information included in the report information; and the return water pump control module is configured to, according to a determined result of the state identification module that the user is coming back, turn on a return water pump to permit water outputted from a water outlet of the water heater to return to the water heater through a water return port.

In an embodiment, the apparatus further includes an outlet water temperature detection module:

the outlet water temperature detection module is configured to detect a temperature of water output from the water outlet; and the return water pump control module is further configured to switch off the return water pump, according to a detection result of the outlet water temperature detection module that the output water temperature at the water outlet exceeds a preset temperature value.

In an embodiment, the apparatus further includes a weather condition acquiring module and a temperature setting module:

the weather condition acquiring module is configured to acquire weather conditions of the day; and the temperature setting module is configured to preset a temperature value according to the weather conditions of the day.

In an embodiment, the temperature setting module is further configured to adjust the preset temperature value according to the user's physiological indexes included in the report information.

In an embodiment, the temperature setting module is further configured to adjust the preset temperature value according to preferences of the user.

In an embodiment, the apparatus further includes a work mode detection module and a time detection module:

the work mode detection module is configured to detect whether the water heater is currently in a specified work mode; and the time detection module is configured to, according to a detection result of the work mode detection module that the water heater is currently in the specified work mode, further determine whether current time is within a preset time range of the specified work mode, and if the current time is within the time range provided in the specified work mode, instruct the state identification module to perform an operation of determining whether the user is coming back according to the user location information included in the report information.

In an embodiment, the state identification module specifically determines whether the user is moving toward a location of the water heater according to the user location information included in the report information; if the user is moving toward the location of the water heater, further determines whether a distance between the current user location and the location of the water heater is less than a first predetermined distance; and if the distance between the current user location and the location of the water heater is less than the first predetermined distance, determines that the user is coming back.

In an embodiment, the state identification module is further configured to, when the user is moving toward the location of the water heater, determine whether the distance between the current user location and the location of the water heater is less than a second predetermined distance, wherein the second predetermined distance is greater than the first predetermined distance; and if the distance between the current user location and the location of the water heater is less than the second predetermined distance, start the water heater to heat when the water heater is in a non-heating state, and then perform an operation of determining whether the distance between the current user location and the location of the water heater is less than the first predetermined distance.

In an embodiment, the state identification module specifically sets the distance between the current user location and the location of the water heater to be a first distance; sets the distance between the user location before a predetermined time interval and the location of the water heater to be a second distance; and if the first distance is less than the second distance, determines that the user is moving toward the location of the water heater.

In an embodiment, the device of a user is a wearable device of the user.

According to another aspect of the disclosure, a water heater is provided, which includes the apparatus for controlling a water heater of any one of the foregoing embodiments.

According to another aspect of the disclosure, a controlling system of a water heater is provided, which includes the water heater of any one of the foregoing embodiments, and the device of the user, transmitting the report information at the predetermined frequency, the report information includes a current user location information of the user.

In an embodiment, the report information further includes collected physiological indexes of the user.

In an embodiment, the device of a user is a wearable device of the user.

In an embodiment, the wearable device of the user is an intelligent bracelet.

The details of one or more embodiments of the present disclosure will be provided with reference to the following drawings and the description. Other features, objectives and advantages of the present disclosure will be obvious.

BRIEF DESCRIPTION OF THE DRAWINGS

To illustrate the technical solutions in the embodiments of the present disclosure more clearly, the accompanying drawings for describing the embodiments and the prior art are introduced briefly hereafter. Apparently, the accompanying drawings in the following description are only some embodiments of the present disclosure, and based on the accompanying drawings, other drawings can be obtained by those skilled in the art without creative efforts.

REFERENCE SIGN LIST

Figure 1:
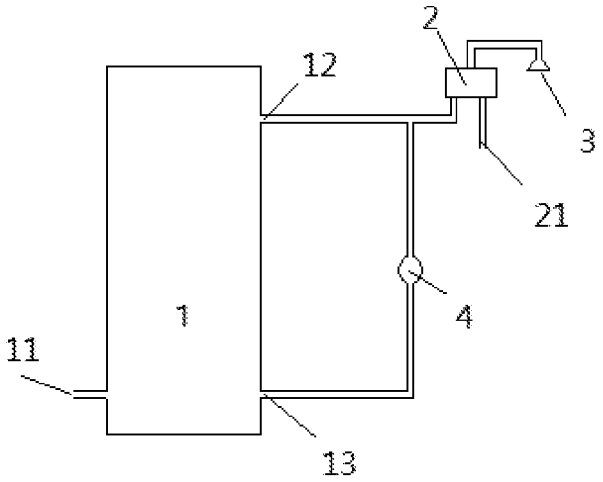
FIG. 1 is a schematic diagram illustrating an embodiment of a water heater in the prior art.

1 water heater;
2 mixing valve;
3 shower head;
4 return water pump;
11 water inlet;
12 water outlet;
13 water return port;
21 cold water outlet;
61 receiving module;
62 state identification module;
63 return water pump control module;
64 outlet water temperature detection module;
65 weather condition acquiring module;
66 temperature setting module;
67 work mode detection module;
68 time detection module;
91 water heater;
92 apparatus for controlling a water heater;
1001 water heater;
1002 wearable device of a user;

DETAILED DESCRIPTION OF THE EMBODIMENTS

The technical solutions in the embodiments of the present disclosure will be clearly and completely described hereafter with reference to the accompanying drawings in the embodiments of the present disclosure. Apparently, the embodiments in the description are merely some embodiments, but not all embodiments of the present disclosure. In fact, the following description of at least one exemplary embodiment is merely illustrative, but not intended to limit the present disclosure and the application or the use thereof. Based on the embodiments of the present disclosure, other embodiments obtained by a person of ordinary skill in the art without creative efforts all fall within the protection scope of the present disclosure.

Unless otherwise specified, the relative arrangements of the components and steps, numeric expressions and values described in these embodiments are not intended to limit the scope of the disclosure.

At the same time, it should be understood that, for convenience of description, the dimensions of the parts shown in the accompanying drawings are not drawn to scale according to the actual proportion.

The technologies, methods and equipment known to those of ordinary skill in the art may not be discussed in detail, but, where appropriate, the technologies, the methods and the equipment shall be considered as part of the granted specification.

In all the examples shown and discussed herein, any specific value should be interpreted as merely an example, but not as a limitation. Other examples of illustrative embodiments may therefore have different values.

It should be noted that similar reference numerals and letters in the following figures denote similar terms, therefore once a particular term is defined in one of the figures, no further discussion is required in the subsequent figures.

Figure 2:
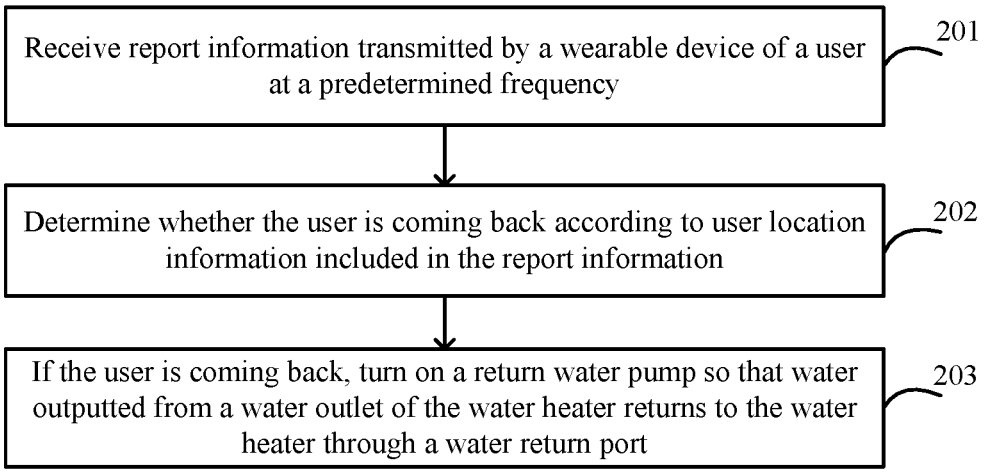
FIG. 2 is a schematic diagram illustrating an embodiment of a method for controlling a water heater according to the present disclosure.

FIG. 2 is a schematic diagram illustrating an embodiment of a method for controlling a water heater according to the present disclosure. The steps of the method of this embodiment can be performed by an apparatus for controlling a water heater.

At step 201, receive report information transmitted by a wearable device of a user at a predetermined frequency.

The wearable device of the user may be an intelligent bracelet or any other smart device.

At step 202, determine whether the user is coming back according to user location information included in the report information.

At step 203, if the user is coming back, turn on a return water pump so that water outputted from a water outlet of the water heater returns to the water heater through a water return port.

Optionally, after receiving the report information transmitted by the wearable device of the user, further determine whether the water heater is currently in a specified work mode; if the water heater is currently in the specified work mode, further determine whether current time is within a preset time range of the specified work mode; if the current time is within the preset time range of the specified work mode, then perform the step of determining whether the user is coming back according to the user location information included in the report information.

By setting the specified work mode and the time range, the user can avoid mistriggerring the water heater due to any normal activities under other conditions.

Based on the method for controlling a water heater provided in the foregoing embodiments of the present disclosure, determine the movement direction and the user location by using report information transmitted by the wearable device of the user, and further determine whether the user is coming back or not; if the user is coming back, turn on the return water pump to permit the water to return, so that the user can take a hot bath immediately after arriving home, thereby improving user experience.

Figure 3:
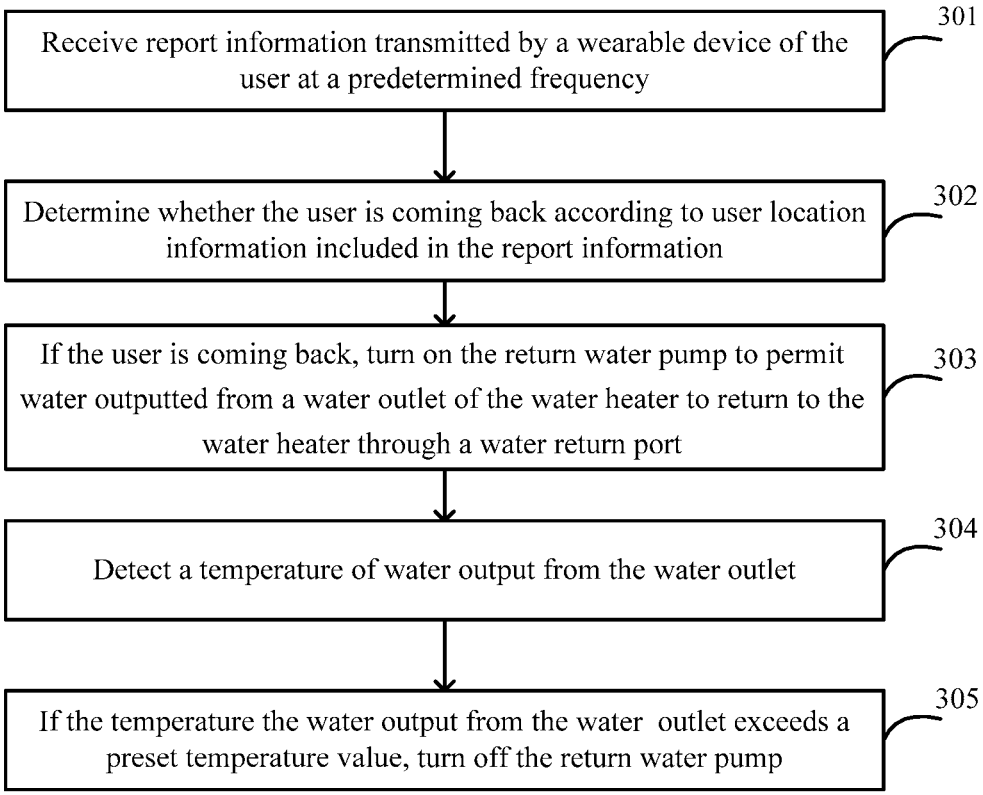
FIG. 3 is a schematic diagram illustrating another embodiment of a method for controlling a water heater according to the present disclosure.

FIG. 3 is a schematic diagram illustrating another embodiment of a method for controlling a water heater according to the present disclosure. The steps of the method of this embodiment can be performed by an apparatus for controlling a water heater.

At step 301, receive report information transmitted by a wearable device of the user at a predetermined frequency.

At step 302, determine whether the user is coming back according to user location information included in the report information.

At step 303, if the user is coming back, turn on the return water pump to permit water outputted from a water outlet of the water heater to return to the water heater through a water return port.

At step 304, detect a temperature of water output from the water outlet.

At step 305, if the temperature the water output from the water outlet exceeds a preset temperature value, turn off the return water pump.

Optionally, the temperature value can be preset based on weather conditions of the day by acquiring the weather conditions of the day. For example, when the weather is hot, the preset temperature value of the water output from the water outlet can be reduced; when the weather is cold, the preset temperature value of the water output from the water outlet can be increased.

In addition, the preset temperature value may be adjusted according to the user's physiological indexes included in the report information. For example, the user's physiological indexes include physiological parameters such as body temperature, heart rate, and blood pressure, etc. If the user feels uncomfortable, the physiological indexes will be abnormal. In this case, the preset temperature value of the water output from the water outlet can be increased, so as to protect the user's health and improve the user's experience.

Optionally, the preset temperature value may be adjusted according to the preferences of the user. For example, the user usually prefers a higher water temperature when bathing, then the preset temperature value of the water output from the water outlet will be increased accordingly. If the user prefers a lower water temperature when bathing, then the preset temperature value of the water output from the water outlet will be reduced accordingly.

Figure 4:
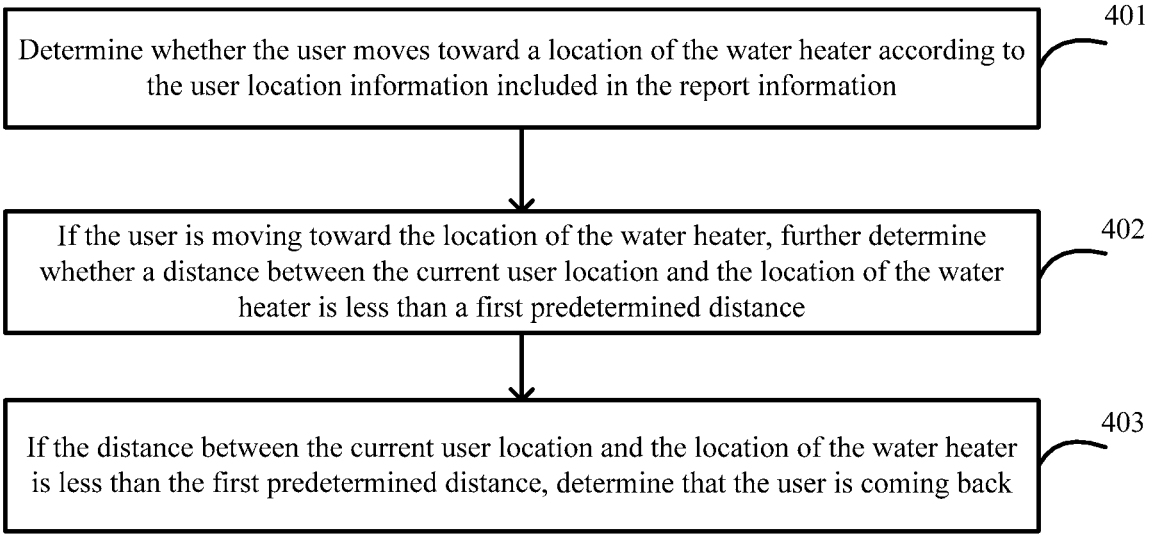
FIG. 4 is a schematic diagram illustrating yet another embodiment of a method for controlling a water heater according to the present disclosure.

FIG. 4 is a schematic diagram illustrating yet another embodiment of a method for controlling a water heater according to the present disclosure. The foregoing step of determining whether the user is coming back according to the user location information included in the report information can include:

At step 401, determine whether the user moves toward a location of the water heater according to the user location information included in the report information.

The distance between the current user location and the location of the water heater is a first distance L1, and the distance between the user location before a predetermined time interval (for example, 10 seconds) and the location of the water heater is a second distance L2. If the first distance L1 is less than the second distance L2, it is determined that the user is moving toward the location of the water heater.

The distance between the user location and the location of the water heater is decreasing, thus it can be determined that the user is moving toward the location of the water heater.

At step 402, if the user is moving toward the location of the water heater, further determine whether a distance between the current user location and the location of the water heater is less than a first predetermined distance.

At step 403, if the distance between the current user location and the location of the water heater is less than the first predetermined distance, determine that the user is coming back.

For example, if it is determined that the user is moving toward the location of the water heater, and that the user is less than 10 metres away from the location of the water heater, then it can be determined that the user is coming back.

Figure 5:
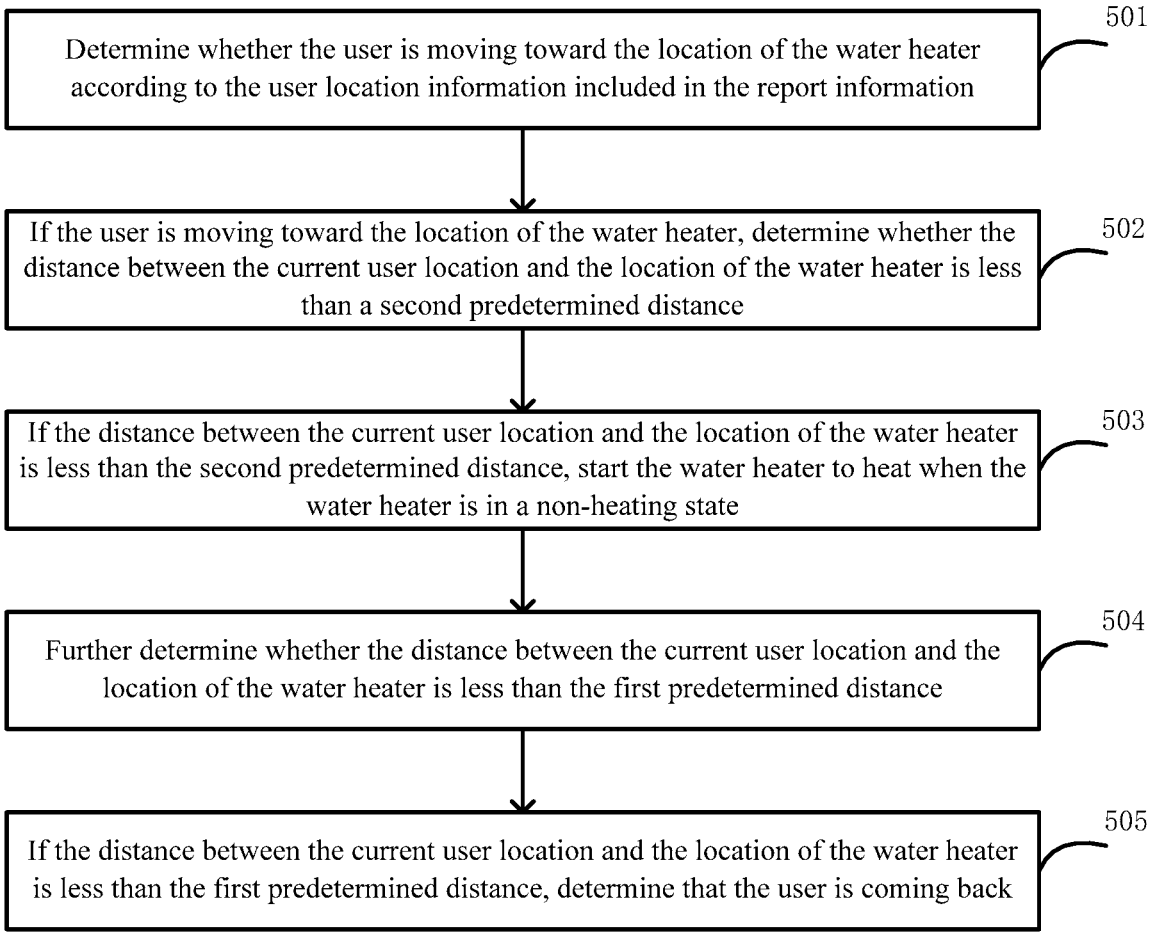
FIG. 5 is a schematic diagram illustrating yet another embodiment of a method for controlling a water heater according to the present disclosure.

FIG. 5 is a schematic diagram illustrating yet another embodiment of a method for controlling a water heater according to the present disclosure. The step of determining whether the user is coming back according to the user location information included in the report information can further include:

At step 501, determine whether the user is moving toward the location of the water heater according to the user location information included in the report information.

At step 502, if the user is moving toward the location of the water heater, determine whether the distance between the current user location and the location of the water heater is less than a second predetermined distance.

At step 503, if the distance between the current user location and the location of the water heater is less than the second predetermined distance, start the water heater to heat when the water heater is in a non-heating state.

In this embodiment, in order to save electricity, the water heater is in a non-heating state when it is not in use. If it is determined that the user is coming back, and that the user is less than 100 meters away home, then the water heater can start heating, so that electricity can be saved without affecting the user's taking a bath.

At step 504, further determine whether the distance between the current user location and the location of the water heater is less than the first predetermined distance.

The second predetermined distance is greater than the first predetermined distance.

At step 505, if the distance between the current user location and the location of the water heater is less than the first predetermined distance, determine that the user is coming back.

In other words, the water heater can usually be in the non-heating state. In the specified work mode and within the preset time range, if it is detected that the user is coming back, and that the user is less than 100 meters away home, then the water heater is triggered to heat; and if the user is less than 10 meters away home, then the return water pump is triggered to permit the water to return, so that the user can take a hot bath immediately after arriving home.

Figure 6:
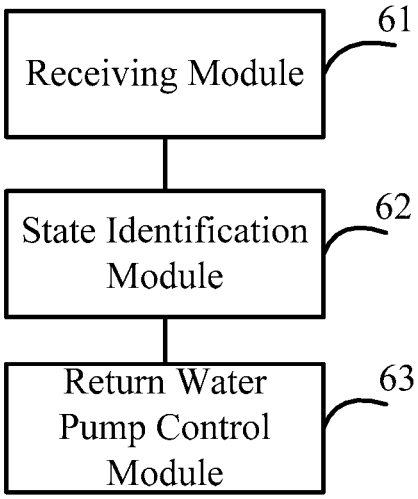
FIG. 6 is a schematic diagram illustrating an embodiment of an apparatus for controlling a water heater according to the present disclosure.

FIG. 6 is a schematic diagram illustrating an embodiment of an apparatus for controlling a water heater according to the present disclosure. As shown in FIG. 6, the apparatus for controlling a water heater can include a receiving module 61, a state identification module 62, and a return water pump control module 63.

The receiving module 61 is configured to receive the report information transmitted by a wearable device of the user at a predetermined frequency.

The state identification module 62 is configured to determine whether the user is coming back according to the user location information included in the report information.

The return water pump control module 63 is configured to, according to a determined result of the state identification module 62 that the user is coming back, turn on a return water pump to permit the water outputted from a water outlet of the water heater to return to the water heater through a water return port.

Based on the apparatus for controlling the water heater provided in the foregoing embodiments of the present disclosure, the movement direction and the location of the user are determined by using the report information transmitted by the wearable device of the user. If the user is coming back, the return water pump is turned on to permit water to return, so that the user can take a hot bath immediately after arriving home, thereby improving the user's experience.

Figure 7:
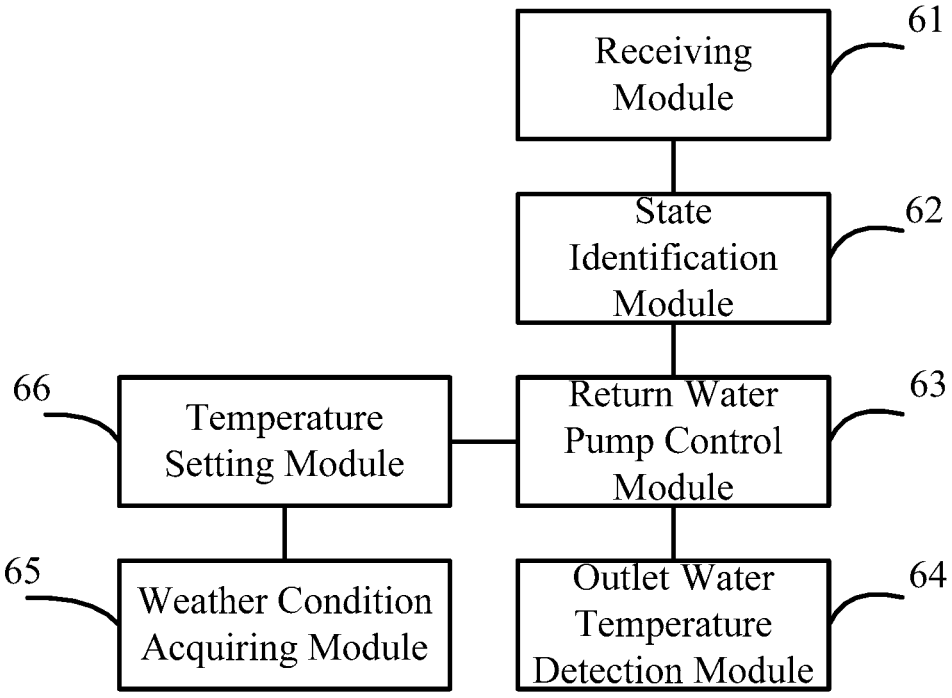
FIG. 7 is a schematic diagram illustrating another embodiment of an apparatus for controlling a water heater according to the present disclosure.

FIG. 7 is a schematic diagram illustrating another embodiment of an apparatus for controlling a water heater according to the present disclosure. Compared with the embodiment shown in FIG. 6, the apparatus for controlling a water heater shown in FIG. 7 further includes an outlet water temperature detection module 64.

The outlet water temperature detection module 64 is configured to detect the temperature of the water output from the water outlet.

The return water pump control module 63 is further configured to switch off the return water pump, according to the detection result of the outlet water temperature detection module 64 that the temperature of the water output from the water outlet exceeds the preset temperature value.

Optionally, as shown in FIG. 7, the apparatus for controlling the water heater can further include a weather condition acquiring module 65 and a temperature setting module 66.

The weather condition acquiring module 65 is configured to acquire weather conditions of the day.

The temperature setting module 66 is configured to preset a temperature value according to the weather conditions of the day.

Thus, the temperature value can be preset according to the weather conditions of the day by acquiring the weather conditions of the day. For example, when the weather is hot, the preset temperature value of the water output from the water outlet can be reduced; when the weather is cold, the preset temperature value of the water output from the water outlet can be increased.

Optionally, the temperature setting module 66 is further configured to adjust the preset temperature value according to the user's physiological indexes included in the report information.

The user's physiological indexes can include the physiological parameters such as body temperature, heart rate, and blood pressure, etc. If the user feels uncomfortable, the physiological indexes will be abnormal. In this case, the preset temperature value of the water output from the water outlet can be increased, so as to protect the user's health and improve the user's experience.

Optionally, the temperature setting module 66 is further configured to adjust the preset temperature value according to the preferences of the user. For example, the user usually prefers a higher water temperature when bathing, then the preset temperature value of the water output from the water outlet will be increased accordingly. If the user prefers a lower water temperature when bathing, then the preset temperature value of the water output from the water outlet will be reduced accordingly.

Figure 8:
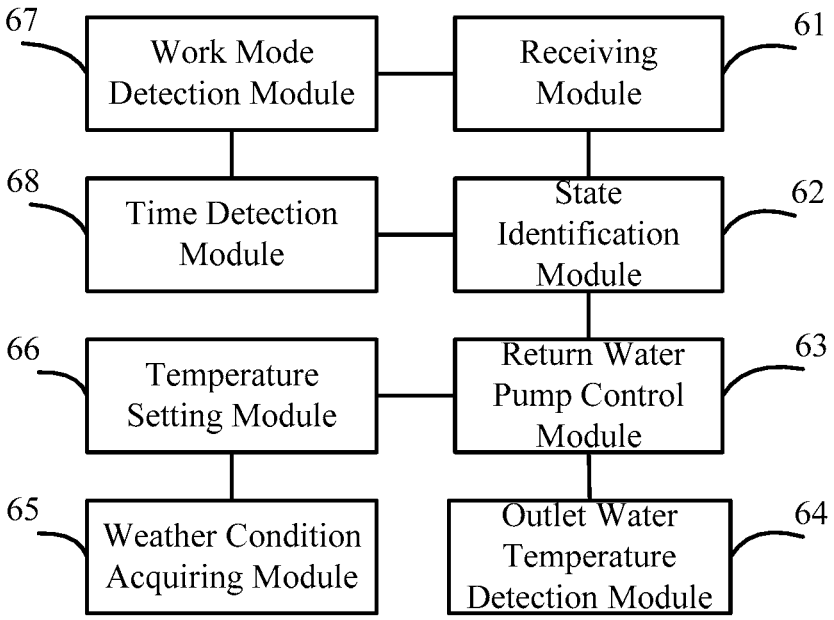
FIG. 8 is a schematic diagram illustrating yet another embodiment of an apparatus for controlling a water heater according to the present disclosure.

FIG. 8 is a schematic diagram illustrating yet another embodiment of an apparatus for controlling a water heater according to the present disclosure. Compared with the embodiment shown in FIG. 7, in the embodiment shown in FIG. 8, the apparatus for controlling the water heater further includes a work mode detection module 67 and a time detection module 68.

The work mode detection module 67 is configured to detect whether the water heater is currently in a specified work mode.

The time detection module 68 is configured to, according to a detection result of the work mode detection module 67 that the water heater is currently in the specified work mode, further determine the current time is within a preset time range of the specified work mode, and if the current time is within a preset time range of the specified work mode, instruct the state identification module 62 to perform an operation of determining whether the user is coming back according to the user location information included in the report information.

By setting the specified work mode and the time range, mistriggering can be avoided.

In the foregoing embodiments, the state identification module 62 specifically determines whether the user is moving toward a location of the water heater according to the user location information included in the report information; if the user is moving toward the location of the water heater, further determines whether a distance between the current user location and the location of the water heater is less than a first predetermined distance; and if the distance between the current user location and the location of the water heater is less than the first predetermined distance, determines that the user is coming back.

The state identification module 62 specifically sets the distance between the current user location and the location of the water heater to be a first distance; sets the distance between the user location before a predetermined time interval and the location of the water heater to be a second distance; and if the first distance is less than the second distance, determines that the user is moving toward the location of the water heater.

Optionally, the state identification module 62 is further configured to, when the user is moving toward the location of the water heater, determine whether the distance between the current user location and the location of the water heater is less than the second predetermined distance, wherein the second predetermined distance is greater than the first predetermined distance; and if the distance between the current user location and the location of the water heater is less than the second predetermined distance, start the water heater to heat when the water heater is in a non-heating state, and then perform the step of determining whether the distance between the current user location and the location of the water heater is less than the first predetermined distance.

In other words, the water heater can usually be in the non-heating state. In the specified work mode and within the preset time range, if it is detected that the user is coming back, and that the user is less than 100 meters away home, then the water heater is triggered to heat; and if the user is less than 10 meters away home, then the return water pump is triggered to permit the water to return, so that the user can take a hot bath immediately after arriving home.

Figure 9:
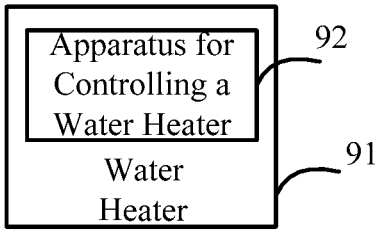
FIG. 9 is a schematic diagram illustrating an embodiment of a water heater according to the disclosure.

FIG. 9 is a schematic diagram illustrating an embodiment of a water heater according to the disclosure. As shown in FIG. 9, the water heater 91 includes an apparatus 92 for controlling the water heater. The apparatus 92 for controlling the water heater can be the apparatus for controlling the water heater according to any one of the embodiments of FIGS. 6 to 8.

Figure 10:
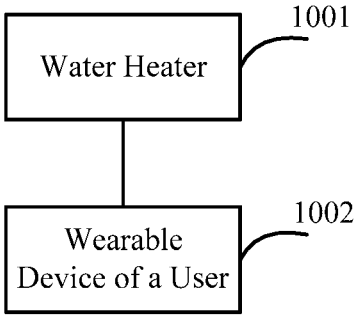
FIG. 10 is a schematic diagram illustrating an embodiment of a controlling system of a water heater according to the present disclosure.

FIG. 10 is a schematic diagram illustrating an embodiment of a controlling system of a water heater according to the present disclosure. As shown in FIG. 10, the system includes a water heater 1001 and a wearable device 1002 of the user.

The water heater 1001 can be the water heater according to any one of the embodiments of FIG. 9.

The wearable device 1002 of the user transmits the report information at a predetermined frequency, and the report information includes the current user location information.

In addition, the report information can include the collected user's physiological indexes.

Optionally, the wearable device of the user can be an intelligent bracelet or any other smart device.

The present disclosure determines the movement direction and the location of the user by using the report information transmitted by the wearable device of the user, and determines whether the user is coming back. If the user is coming back, the return water pump is turned on to permit the water to return, so that the user can take a hot bath immediately after arriving home. Also, the temperature of the hot water can be adjusted automatically according to the weather conditions, the user's physical conditions, and the user's preferences, thereby improving the user's experience.

Those skilled in the art should understand that the embodiments of the present disclosure may be provided as methods, systems, or computer program products. Therefore, the present disclosure can be implemented by complete hardware embodiments, complete software embodiments, or embodiments combining software and hardware. Furthermore, the present disclosure can be implemented by a computer program product implemented on one or multiple computer-usable non-transitory storage media (including but not limited to disk memory, CD-ROM, and optical memory, etc.) including computer-usable program code.

The present disclosure is described with reference to a method, a device (system), and a flowchart and/or block diagram of a computer program product according to embodiments of the present disclosure. It should be understood that the computer program instructions can be used to implement each process in the flow chart and/or be used to implement each block in the block diagram, and be used to implement the combination of processes blocks in the flow chart and/or blocks in the block diagram. These computer program instructions can be provided to a processor of a general purpose computer, a processor of a dedicated computer, a processor of an embedded processor or a processor of other programmable data processing device to produce a machine, such that instructions executed by a processor of a computer or a processor of other programmable data processing device produce means for implementing functions specified in one or multiple processes of the flow chart and/or one or multiple blocks of the block diagrams.

These computer program instructions can also be stored in a computer-readable memory that can direct a computer or any other programmable data processing device to work in a particular manner, so that the instructions stored in the computer-readable memory produce manufactures including an instruction device, and the instruction device implements the functions specified in one or more processes of the flow chart and/or one or more blocks of the block diagram.

These computer program instructions can also be loaded into a computer or any other programmable data processing device, so that a series of operational steps are performed in the computer or any other programmable device to produce computer-implemented processing, whereby instructions executed on the computer or on any other programmable device provide steps for implementing the functions specified in one or more processes of the flow chart and/or one or more blocks of the block diagram.

The description of the disclosure is provided for the purpose of illustration and description, and is not comprehensive or limited to the aspects disclosed. Many modifications and changes are apparent to those of ordinary skill in the art. The selection and description of embodiments are intended to better illustrate the principles and practical applications of the disclosure and to enable those of ordinary skill in the art to understand the present disclosure, so as to design various embodiments with various modifications suitable for specific uses.

What is claimed is:

1. A method for controlling a water heater, the method comprising:

receiving report information transmitted by a device of a user at a predetermined frequency;

determining whether the user is moving toward a location of the water heater according to the user location information comprised in the report information;

determining that the user is moving toward the location of the water heater, and then determining whether a distance between a current user location and the location of the water heater is less than a second predetermined distance;

determining that the distance between the current user location and the location of the water heater is less than the second predetermined distance, and then starting the water heater to heat when the water heater is in a non-heating state, and further determining whether the distance between the current user location and the location of the water heater is less than a first predetermined distance, wherein the second predetermined distance is greater than the first predetermined distance; and determining that the distance between the current user location and the location of the water heater is less than the first predetermined distance, and then determining that the user is coming back, and turning on a return water pump to permit water outputted from a water outlet of the water heater to return to the water heater through a water return port.

2. The method of claim 1, further comprising:

detecting a temperature of water output from the water outlet;

determining that the temperature of the water output from the water outlet exceeds a preset temperature value, and then turning off the return water pump.

3. The method of claim 2, further comprising:

acquiring weather conditions of a day;

presetting a temperature value according to the weather conditions of the day.

4. The method of claim 3, further comprising:

adjusting the preset temperature value according to the user's physiological indexes comprised in the report information; or adjusting the present temperature value according to preferences of the user.

5. The method of claim 1, wherein:

after the receiving the report information transmitted by the device of the user at the predetermined frequency, the method further comprises:

determining whether the water heater is currently in a specified work mode;

determining that the water heater is currently in the specified work mode, and then further determining whether current time is within a preset time range of the specified work mode; and determining that the current time is within the preset time range of the specified work mode, and then performing the determining whether the user is moving toward a location of the water heater according to the user location information comprised in the report information.

6. The method of claim 1, wherein:

the step of determining whether the user is moving toward the location of the water heater according to the user location information comprised in the report information comprises:

setting the distance between the current user location and the location of the water heater to be a first distance;

setting the distance between the user location before a predetermined time interval and the location of the water heater to be a second distance; and determining that the first distance is less than the second distance, and then determining that the user is moving toward the location of the water heater.

* * * * *